US007386973B2

(12) United States Patent
Madill, Jr.

(10) Patent No.: US 7,386,973 B2
(45) Date of Patent: Jun. 17, 2008

(54) RETRACTABLE STIRRUP DESIGNED FOR COMPACT STORAGE

(76) Inventor: Robert Richard Madill, Jr., P.O. Box 4732, Cave Creek, AZ (US) 85327

( * ) Notice: Subject to any disclaimer, the term of this patent is extended or adjusted under 35 U.S.C. 154(b) by 315 days.

(21) Appl. No.: 11/379,609

(22) Filed: Apr. 21, 2006

(65) Prior Publication Data

US 2007/0245696 A1 Oct. 25, 2007

(51) Int. Cl.
*B68C 1/16* (2006.01)

(52) U.S. Cl. ..... 54/46.1; 54/47; 182/90; 114/362

(58) Field of Classification Search ..... 54/46.1, 54/47, 48; 182/90, 196; 114/362
See application file for complete search history.

(56) References Cited

U.S. PATENT DOCUMENTS 674,485 A * 5/1901 Stewart ..... 54/48
706,468 A 5/1902 Wellman
1,450,207 A * 4/1923 Gaken ..... 182/71
1,700,718 A 1/1929 Roberts
2,651,789 A * 9/1953 Newland ..... 114/362
2,935,833 A * 5/1960 Woodhead ..... 54/48
3,234,711 A 2/1966 Jamieson
4,120,377 A * 10/1978 Charles et al. ..... 182/3
4,601,161 A 7/1986 Drellich
4,761,938 A 8/1988 Townsend
5,347,797 A 9/1994 Seal et al.
5,661,957 A 9/1997 Daly
5,738,340 A * 4/1998 Brantner ..... 254/337
6,026,633 A 2/2000 Burke, Jr.
6,282,872 B1 9/2001 Schulte
6,688,088 B1 2/2004 Aweeka, Jr.
6,748,727 B1 6/2004 Schulte
6,792,887 B1 * 9/2004 Baker ..... 114/362

* cited by examiner

*Primary Examiner*—Rob Swiatek

(57) ABSTRACT

An apparatus that provides for a conveniently removable mounting stirrup that assists a rider in climbing into a riding saddle, and provides for compact storage. The removable mounting stirrup includes features for a convenient saddle attachment and removal while on top of the riding animal.

9 Claims, 2 Drawing Sheets

RETRACTABLE STIRRUP DESIGNED FOR COMPACT STORAGE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING COMPACT DISC APPENDIX

Not applicable.

BACKGROUND OF THE INVENTION

1. Field of the Invention

The present invention is a portable and retractable stirrup especially useful for equestrian riding. The retractable stirrup is an additional stirrup temporarily attached to the saddle of a riding animal, such as a horse. It allows a rider a method to assume the correct riding position on a horse when the normal riding stirrup is too high for the rider to conveniently place his foot into the stirrup. The retractable stirrup provides a type of stair movement that greatly assists a rider with limited leg movement such as the elderly, with a smaller size such as children, or when the horse is at a higher elevation than the rider. The stirrup has been particularly designed to require a very small storage space, as storage on a riding saddle is normally very limited.

2. Discussion of Related Art

U.S. Pat. No. 6,688,088 describes a horse mounting aid method that includes a second smaller stirrup that is mounted just below the horse mounting stirrup. This additional stirrup has practical problems in actual use. The stirrup may be drawn up under the fender and/or side jockey when not used. This places the equipment in contact with the horse causing chafing and injury. It is difficult and dangerous for the rider to actually remove the temporary stirrup without falling to the ground because the rider must lean over to remove it. Finally, there is no provision to securely lock the temporary stirrup to the stirrup leather.

U.S. Pat. No. 5,661,957 describes an extendible stirrup for a horse. One of the saddle riding stirrups is mounted on a spring loaded mechanism. Since the mechanism is designed to serve two purposes, which allow a rider to easily mount onto the horse, and also provide for a secured riding position, the retraction mechanism is overly complicated with a long list of many moving parts (col. 11, 12).

U.S. Pat. No. 5,347,797 describes a temporary mounting stirrup for a horse. The temporary mounting stirrup is looped around the saddle horn and provides a lower stirrup for the rider to lift upwardly to a higher elevation with the right foot. The storage of the temporary mounting stirrup is poorly designed, by looping the strap and securing the loop with a D ring and clip. The temporary stirrup remains hanging from the saddle, and creates a hazard of catching on objects, such as brush or tree limbs. It may be removed by lifting the strap over the horn, but the strap does not loop conveniently into a compact storage. It is difficult for a rider to place a foot into the strap when the rider has limited leg movement. The strap does not have a defined opening for the foot, which is inconvenient for the rider and, when used, causes painful side pressure on the foot. The strap is not secured to the saddle horn and there is the likelihood of the strap falling off when riding hard. There is no provision for placing the strap immediately behind the normal riding stirrup. A person with poor leg motion will find it hard to cross the legs in the cramped space between stirrups to get the correct leg into the normal riding stirrup.

U.S. Pat. No. 4,761,938 describes a stirrup extension that hooks onto the existing riding stirrup, but there is no safe and convenient method for the rider to remove the extension without leaning over severely to reach the top of the device. It has limited use as it is dangerous to leave the extension on the riding stirrup as it may catch on tree limbs and bush, and further, it is liable to fall off.

U.S. Pat. No. 4,601,161 describes a leg up strap that is designed to assist the rider in climbing onto a horse. The strap has limited use as there is no provision for the rider to remove the strap from the horse when mounted. It is hazardous to leave the strap in place while riding, and the flexible foot opening creates unwanted side pressure on the foot as already mentioned in previous discussions on other patents.

BRIEF SUMMARY OF THE INVENTION

This invention pertains to a conveniently removable mounting stirrup that may be designed for various lengths, allows the rider the ability to climb into a riding saddle with limited leg movement, and provides for convenient, very compact storage. The mounting position and mechanism facilitates an easy and secure method of attachment, and also a convenient way for the rider to store the stirrup and to re-attach it while on top of the riding animal.

DETAILED DESCRIPTION OF THE INVENTION

One important goal of this invention is to provide a method to allow a rider with limited leg movement to more easily mount up on an equestrian saddle. It also provides suitable assistance for riders with shorter legs, such as children.

Another important goal of this invention is to provide a method where the temporary mounting stirrup is conveniently removed and stored by a rider in a bag, such as a saddle bag. The device has been particularly designed with consideration to this by using flexible material, to the extent practical, so it may be stored in a very compact space. It also has been designed so that the flexible material will conveniently wind around a winding buckle, such as used in seat belts. The stirrup has been designed to be light weight and present little hazard under normal use.

Figure 1:
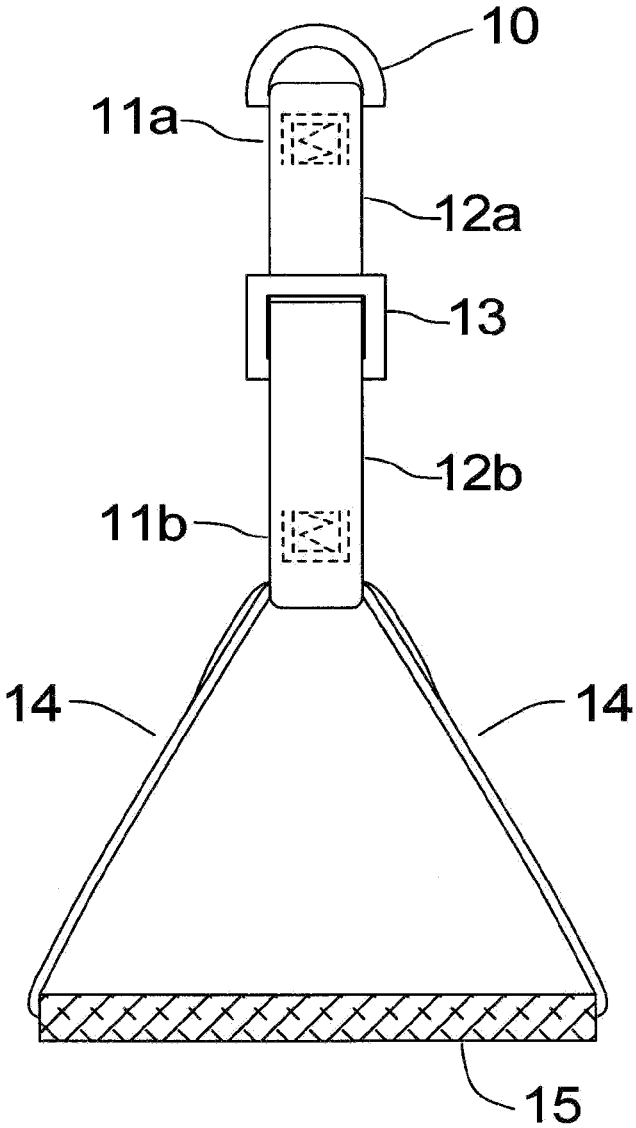
FIG. 1 is a front view of the retractable stirrup assembly.

FIG. 1 shows a front view of the retractable mounting stirrup in the retracted position. A D Ring 10 at one end allows for saddle attachment. As an alternate, a round ring may also be used. An upper strap 12*a* interconnects the D Ring 10 and a winding buckle 13. The upper strap 12*a* is attached to the D Ring 10 by looping the upper strap 12*a* around the D Ring 10 and securing it by suitable upper strap stitching 11*a*. Other methods of securing the upper strap 12*a* to the D Ring 10 may be employed. These methods may include mechanical crimps, rivets, glue, wire, etc. that are well known in the art. A lower strap 12*b* is attached to a continuous stirrup strap 14 that loops through the lower strap 12*b* and the stirrup tread 15. Similar to the upper strap stitching 11*a*, the lower strap 12*b* connects to the continuous stirrup strap 14 by looping around the continuous stirrup strap 14, as shown, and securing it with suitable lower strap stitching 11*b*. Other methods may be employed to secure the lower strap 12*b* to the continuous stirrup strap 14 as already mentioned for the upper strap 12*a*. The continuous stirrup strap 14 may be connected to the lower strap 12*b* in a manner to prevent sliding or it may be rigidly attached. The continuous stirrup strap 14 and stirrup tread 15 create a near triangular shape which makes is convenient for a rider to place a foot into the opening. The stirrup tread is made of a rigid material, such as metal or plastic, to define the triangular shape without the necessity for a rider to manually create a space for the foot by using his or her hands. The rigid stirrup tread also prevents the continuous stirrup strap 14 from putting side pressure on the rider's foot. Other prior art devices do not consider the difficulty some individuals have with this issue.

The upper strap 12*a* and lower strap 12*b* are preferably the same type of strap to ensure that the winding buckle 13 will function properly; however, this is not a requirement. The winding buckle 13 may also be designed to wind up the upper strap 12*a*, the lower strap 12*b*, or both straps. The continuous stirrup strap 14, the upper strap 12*a*, and lower strap 12*b* may be the same or different types of material. Any suitable strap material may be used that will carry the required load safely, and have appropriate wear properties. In a preferred embodiment, a strap material that is suitable for a seat belt is used for all three straps.

Figure 2:
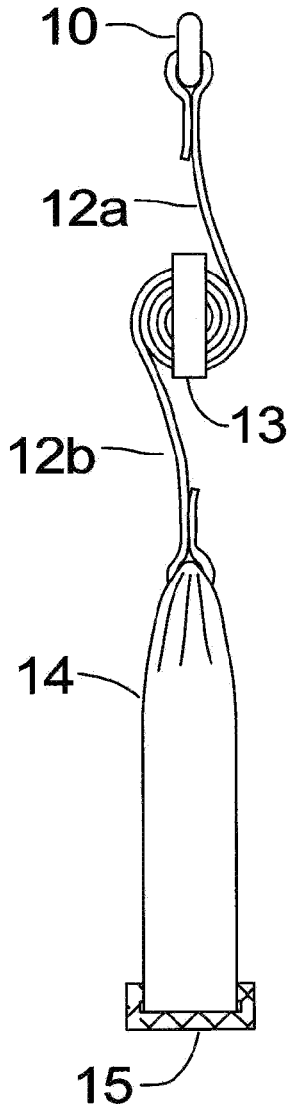
FIG. 2 is a side view of the retractable stirrup assembly.

FIG. 2 shows a side view of FIG. 1 to provide further clarification. The winding buckle 13 is preferably a commonly used strap winding system such as distributed by SeatBeltPros.com, P.O. Box 1554, Langley, Wash. 98260 and provides for a spring driven winding mechanism. Other types of strap winding mechanisms may also be employed by methods well known in the art, which provide for mechanical strap winding featuring the use of a spring, and are readily available commercially.

An important embodiment of the current invention is to allow the length of the retractable stirrup to be varied. This may be done by increasing the length of the upper strap 12*a* and lower strap 12*b*. A buckle or adjustable belt can also be added to either strap to vary the length. As an alternative, similar devices that provide for strap length adjustment may be applied that are well known in the art.

The stirrup tread 15 is preferably of suitable dimensions for functionality and for compact storage. Experiments with different stirrup tread 15 designs found that a rectangular bar with an opening for the continuous stirrup strap 14 with the outside dimensions of 5½ inches long, 1½ inches wide, and ¾ inches tall was suitable. Preferred lengths were found to be 4½ to 6" long, based on typical foot widths. A ¾" wide stirrup tread 15 was found to be too small and allowed the foot to easily slip out. Suitable widths were found to be 1 to 1½" wide. A preferred stirrup tread 15 material is an aluminum rectangular structural tube that is 5½" long, 1" wide, and ½" tall with a ⅛" metal thickness. As a preferred embodiment, the top of the stirrup tread 15 may be modified to prevent foot slippage by adding a slip resistant material or increasing surface roughness as is well known in the art.

Figure 3:
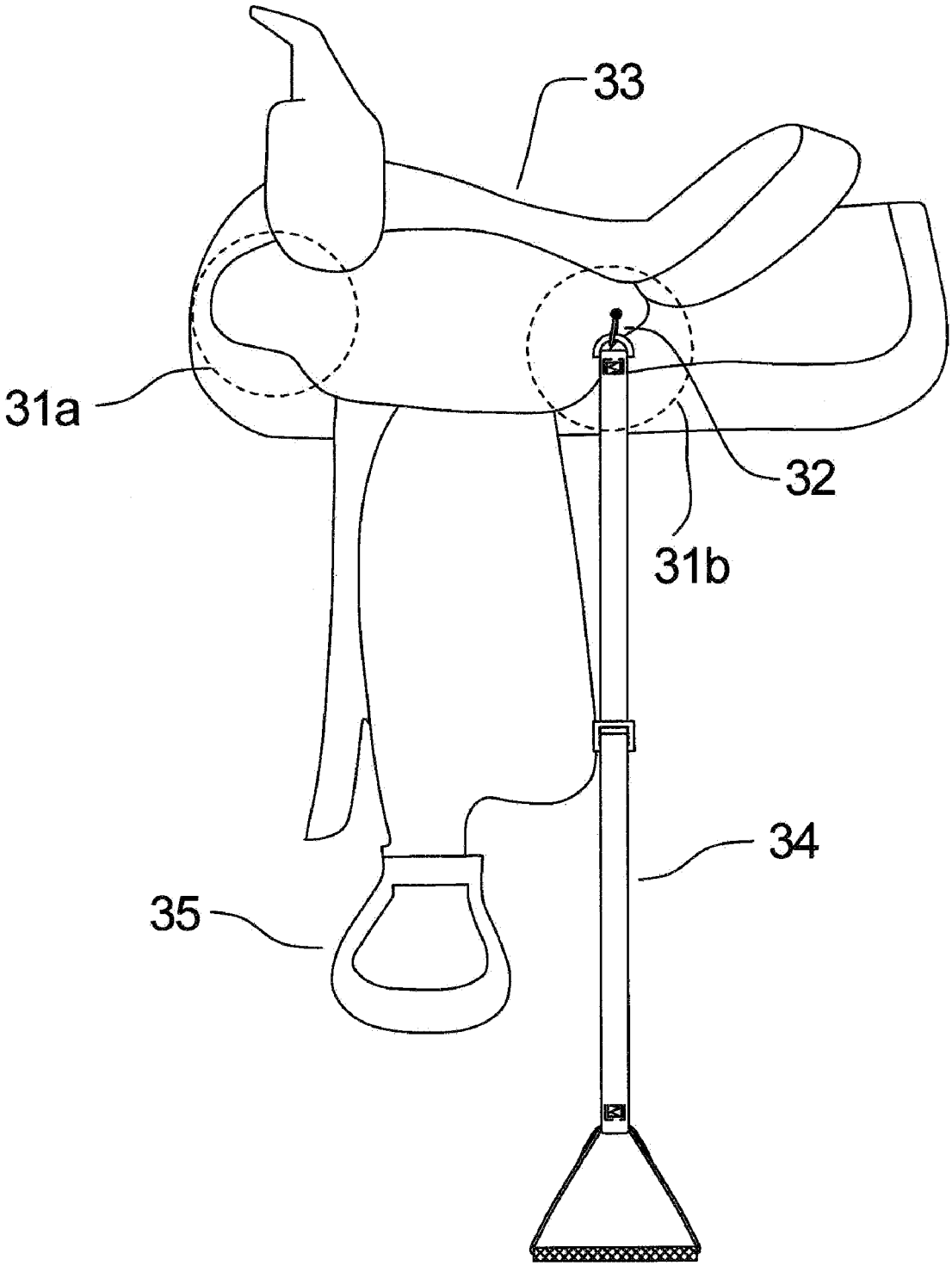
FIG. 3 shows how the retractable stirrup assembly may be attached to a saddle.

FIG. 3 illustrates how the retractable stirrup may be attached to a typical riding saddle 33. A clip 32 is rigidly attached to the saddle so that the retractable stirrup assembly 34 is located behind the normal riding stirrup 35. The retractable stirrup assembly 34 may be located anywhere within the area 31*b*. As an alternate, it may also be located ahead of the normal riding stirrup 35 in area 31*a*. A clip 32 is only one possible method of attachment. Other attachment hardware may be employed, by methods known to those skilled in the art, and include a buckle, hook, snap, latch, or a tie off arrangement. It is preferred that the location of the clip 32 or other mounting hardware is placed where the rider will not have to lean over excessively to remove the retractable stirrup. The attachment should be simple and suitable to carry the weight of the rider, as the retractable stirrup is not meant to replace, or be an alternate for, the normal riding stirrup 35.

The actual use of the retractable stirrup is straight forward. The retractable stirrup is attached to the saddle, the rider pulls the stirrup tread downward until the upper and lower straps are completely extended from the winding buckle, and then the rider puts the right foot into the retractable stirrup. The rider then puts the left food into the normal riding stirrup, swings the right leg over the saddle, and sits. The spring winding mechanism in the winding buckle then retracts the straps automatically, and the rider may then remove the retractable stirrup and store it. Alternatively, the rider may allow the retractable stirrup to remain in place.

In particular, this invention has been conceived to allow for a very compact storage. The unit can be collapsed to fit into a rectangular box 6" inches long, 2" deep, and 2.5" tall which equates to 30 cubic inches. It would also fit into a cylindrically shaped storage bag 6" long with an equal volume. This allows the unit to be conveniently stored by the rider in a saddle bag, knapsack, or other storage place accessible to the rider. The use of flexible straps makes this possible, rather than using many rigid members to define the stirrup assembly.

While various embodiments of the present invention have been described, the invention may be modified and adapted to various uses to those skilled in the art. Therefore, this invention is not limited to the description and figures shown herein, and includes all such changes and modifications that are encompassed by the scope of the claims.

I claim:

1. A retractable stirrup assembly to assist a rider in mounting into a saddle comprising:

a. a ring attached to one end of said retractable stirrup assembly, b. a first flexible strap attached to said ring, c. a strap winding means attached to said first flexible strap, d. a second flexible strap attached to said strap winding means, e. wherein at least one of said first flexible strap and said second flexible strap is designed to be wound by said strap winding means, f. a continuous flexible loop strap attached to said second flexible strap, g. wherein said continuous flexible loop strap is routed through an elongated tread, h. wherein said elongated tread is made from a rigid material, and i. means for attaching said retractable stirrup assembly to said saddle by use of said ring.

2. The retractable stirrup assembly according to claim 1 wherein said ring is a D ring or a circular ring.

3. The retractable stirrup assembly according to claim 1 wherein the length of at least one of said first flexible strap and said second flexible strap is adjustable.

4. The retractable stirrup assembly according to claim 1 wherein said retractable stirrup assembly may be fitted into a storage volume of less than 30 cubic inches inclusive.

5. The retractable stirrup assembly according to claim 1 wherein said elongated tread has a rectangular cross section.

6. The retractable stirrup assembly according to claim 1 wherein said elongated tread is 4.5 to 6 inches long and has a rectangular cross section of 1 to 1.5 inches wide and at least ½ inches tall.

7. The retractable stirrup assembly according to claim 1 wherein said elongated tread incorporates an anti-slip surface.

8. The retractable stirrup assembly according to claim 1 wherein said retractable stirrup assembly is attached to said saddle in front of said rider's normal left foot riding position.

9. The retractable stirrup assembly according to claim 1 wherein said retractable stirrup assembly is attached to said saddle behind said rider's normal left foot riding position.

* * * * *